US006112178A

United States Patent [19]

Kaja

[11] Patent Number: 6,112,178

[45] Date of Patent: Aug. 29, 2000

[54] METHOD FOR SYNTHESIZING VOICELESS CONSONANTS

[75] Inventor: Jaan Kaja, Tyreso, Sweden

[73] Assignee: Telia AB, Farsta, Sweden

[21] Appl. No.: 09/147,466

[22] PCT Filed: Jun. 9, 1997

[86] PCT No.: PCT/SE97/01004

§ 371 Date: Mar. 5, 1999

§ 102(e) Date: Mar. 5, 1999

[87] PCT Pub. No.: WO98/00835

PCT Pub. Date: Jan. 8, 1998

[30] Foreign Application Priority Data

Jul. 3, 1996 [SE] Sweden ..... 9602624

[51] Int. Cl.[7] ..... G10L 13/06

[52] U.S. Cl. ..... 704/267; 704/258

[58] Field of Search ..... 704/258, 267

[56] References Cited

U.S. PATENT DOCUMENTS

| | | | |
|---|---|---|---|
| 4,692,941 | 9/1987 | Jacks et al. | 704/260 |
| 4,833,718 | 5/1989 | Sprague | 704/229 |
| 5,659,664 | 8/1997 | Kaja | 704/265 |

FOREIGN PATENT DOCUMENTS

| | | | |
|---|---|---|---|
| 0363233 A1 | 4/1990 | European Pat. Off. | G10L 13/06 |
| 0561752 A1 | 9/1993 | European Pat. Off. | G10L 13/06 |
| 3220281 A1 | 12/1982 | Germany | G10L 13/06 |
| WO 9632711 A1 | 10/1996 | WIPO | G10L 13/06 |

OTHER PUBLICATIONS

Hamon et al, International Conference on Acoustics, Speech and Signal Processing, "A Diphone Synthesis System Based on Time–Domain Prosodic Modifications of Speech", May 1989, pp. 238–241.

*Primary Examiner*—David R. Hudspeth
*Assistant Examiner*—Tálivaldis Ivars Šmits
*Attorney, Agent, or Firm*—Oblon, Spivak, McClelland, Maier & Neustadt, P.C.

[57] ABSTRACT

A method for synthesizing speech using concatenation and Hanning-windows, in which a synthetic waveform is formed by concatenation of suitably selected parts of recorded human speech, the selected parts being windowed out with a Hanning window and copied into suitably selected locations in the synthetic waveform. The method is adapted to synthesize unvoiced consonants and includes the steps of palindromically copying suitably selected parts of the recorded human speech to form a synthesized waveform for the unvoiced consonant using concatenation. The method may be used for diphone, or polyphone, synthesis. The advantage of this palindromic synthesis method is that when the copying process has been reversed the second time there is either no repetition of identical blocks, or else the time difference between repetitions is markedly larger in comparison with known methods, thus minimizing unwanted periodic artifacts in the synthesized speech.

20 Claims, 1 Drawing Sheet

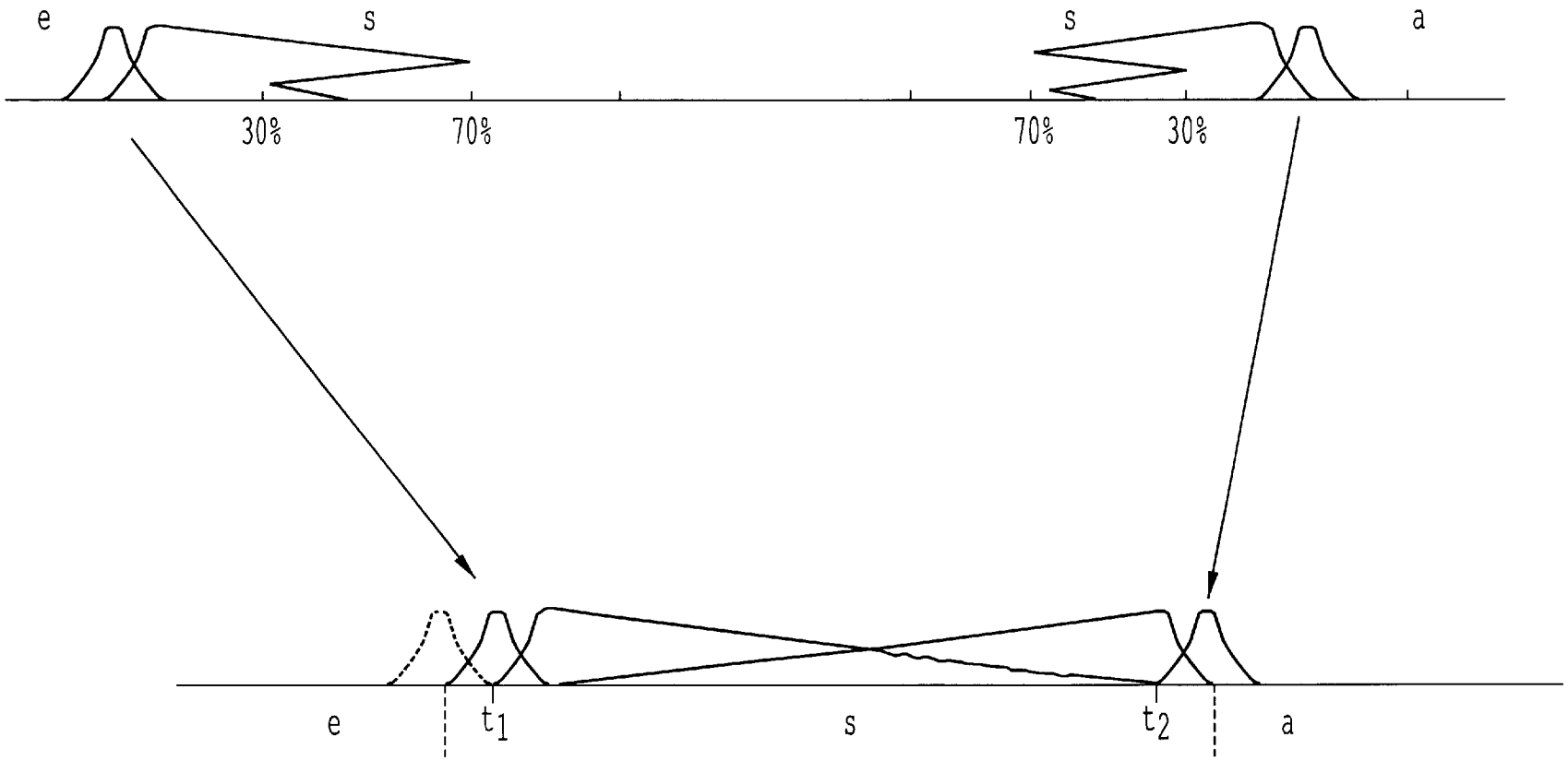
a
s
30%
70%
70%
s
30%
e
a
t2
s
t1
e

METHOD FOR SYNTHESIZING VOICELESS CONSONANTS

BACKGROUND OF THE INVENTION

1. Field of the Invention

The invention relates to a method for synthesising speech using concatenation and, in particular, synthesising voiceless consonants.

2. Discussion of the Background

It is known, in a speech synthesis method, to link together, i.e. concatenate, small sections of sounds which have been recorded by a human speaker. The sounds consist of diphones (i.e. sounds from two phonemes), or polyphones (i.e. a number of phonemes). The advantage of the known method is that the main part of the coarticulation (i.e. common articulation—that part of the pronunciation of a phoneme that is influenced by surrounding phonemes) is located in the area around the phoneme limit, which is included in the recorded sounds, and, as a consequence of this, is reproduced, in a natural human-like manner, in the synthesized speech. The known method also covers the generation of synthetic speech with arbitrary phoneme durations and optional fundamental tone curves, even in those cases where the fundamental tone is in the same register as the person who made the recording from which the speech is synthesised.

In accordance with the known speech synthesis method, the creation of a synthetic waveform is effected by arranging for suitably selected parts of the recorded polyphones to be "out-windowed" with a Hanning-window and copied into suitably selected places in the synthetic waveform. For voiced speech, i.e. voicing sounds, the Hanning-windows are placed in such a manner that the centre of the window is located at the excitation point of a glottis pulse, i.e. at the point in time where the vocal cords are closed.

With unvoiced speech, for example, voiceless consonants, there is no known way of placing the Hanning-windows, for effecting speech synthesis. This problem is, however, generally overcome, in accordance with the known methods, by using a fixed interval between the Hanning-windows. The use of this method, for the synthesis of phonemes of long duration, gives rise to problems, especially in those cases where the synthesised sound needs to be longer than the recorded sound. In such cases, it is necessary to copy the same "out-windowed" signal, in a sequential manner, into a number of suitably selected places in the synthetic waveform. Most people generally have good hearing and are, therefore, able to perceive periodicities, resulting in the synthesised consonants being heard as sounds having a whistling character. If the length of the Hanning-window is larger, a 'chuff-chuff'-like sound will be experienced. This problem can be reduced by reversing the content of every second Hanning-window, i.e. by being played back in reverse. However, this will not totally eliminate the problem.

SUMMARY OF THE INVENTION

It is an object of the present invention to provide a method for synthesising speech using concatenation and, in particular, the synthesis of voiceless consonants which overcomes the problems outlined above.

The invention provides a method for synthesising speech using concatenation and Hanning-windows, in which a synthetic waveform is formed by concatenation of suitably selected parts of recorded human speech, said selected parts being out-windowed with a Hanning-window and copied into suitably selected locations in the synthetic waveform, characterised in that said method is adapted to synthesise unvoiced consonants and includes the steps of palindromically copying suitably selected parts of a waveform of said recorded human speech to form a synthesized waveform for said unvoiced consonant using concatenation. The method may be used for diphone, or polyphone, synthesis.

The invention also provides a method for synthesising speech using concatenation and Hanning-windows, in which a synthetic waveform is formed by concatenation of suitably selected parts of recorded human speech, said selected parts being out-windowed with a Hanning-window and copied into suitably selected locations in the synthetic waveform, characterised in that said method is used for diphone synthesis and includes the steps of:

- selecting a first part of said recorded waveform, said first part being a diphone, a first phoneme of which is a vowel and the other phoneme of which is a consonant required to be synthesised;
- selecting a second part of said recorded waveform, said second part being a diphone, a first phoneme of which is the consonant required to be synthesised and the other phoneme of which is a vowel;
- palindromically copying the start of a synthesised waveform for said consonant from said other phoneme of said first part of said recorded waveform using a first half of a Hanning-window function used to synthesis said vowels;
- palindromically copying the end of the synthesised waveform for said consonant from said first phoneme of said second part of said recorded waveform using the other half of said Hanning-window function; and
- concatenating said start and said end of said synthesised waveform, resulting from said palindromic copying, to form a synthesised waveform for said consonant.

The concatenation may, according to the present invention, include the steps of effecting linear interpolation between the points on said synthesised waveform for said consonant where each half of said Hanning-window function is at a maximum, and the interpolation may be defined by:

- a line which extends, in a linear manner, from a maximum position at the point at which said first half of the Hanning-window function is a maximum to zero at the point at which said other half of said Hanning-window function is a maximum; and
- a line which extends, in a linear manner, from a maximum position at the point at which said other half of the Hanning-window function is a maximum to zero at the point at which said first half of said Hanning-window function is a maximum.

The interpolation lines indicate how much signal has been taken from each of said diphones.

The method may be used for synthesizing the consonant 's', in which case, the diphone of said first part of said recorded waveform includes phonemes for 'e' and 's' and the diphone of said second part of said recorded waveform includes phonemes for 's' and 'a'. The vowels 'e' and 'a' may be synthesized by a Hanning-windowed glottis pulse, and the same Hanning-window function may be used to synthesise a waveform for the consonant 's'.

The copying of the synthesised waveform for said consonant may be effected between two defined lower and upper limits of each of the waveforms of said other phoneme of said first part of said recorded waveform and of said first phoneme of said second part of said recorded waveform. The lower limit may be 30% and the upper limit may be 70%.

In accordance with the method, the copying of the beginning of the waveform for said consonant, from said other phoneme of said first part of said recorded waveform, may include the steps of:

copying said other phoneme starting at the beginning thereof and continuing until said upper limit is reached;

on reaching said upper limit, reversing the copying process and copying said other phoneme between said upper limit and said lower limit; and on reaching said lower limit, continue with the copying process, forwards and backwards, between said upper and lower limits.

In accordance with the method, the copying the end of the synthesised waveform for said consonant, from said first phoneme of said second part of said recorded waveform, includes the steps of:

copying said first phoneme starting at the end thereof and continuing until said upper limit is reached;

on reaching said upper limit, reversing the copying process and copying said first phoneme between said upper limit and said lower limit; and on reaching said lower limit, continue with the copying process, forwards and backwards, between said upper and lower limit The invention further provides a speech synthesis apparatus which operates in accordance with the method, as outlined in the preceding paragraphs, for the synthesis of voiceless consonants.

The invention further provides a speech synthesis apparatus for synthesising speech using concatenation and Hanning-windows, said apparatus including concatenation means for linking together suitably selected parts of a waveform of recorded human speech to form a synthetic waveform for said speech, said selected parts being out-windowed with a Hanning-window, and means for copying said out-windowed parts into suitably selected locations in the synthetic waveform, characterised in that said apparatus is adapted to synthesis unvoiced consonants and in that said suitably selected parts of a waveform of said recorded human speech are palindromically copied and concatenated to form a synthesized waveform for an unvoiced consonant.

The invention further provides a speech synthesis apparatus for synthesising speech using concatenation and Hanning-windows, said apparatus including concatenation means for linking together suitably selected parts of a waveform of recorded human speech to form a synthetic waveform for said speech, said selected parts being out-windowed with a Hanning-window, and means for copying said out-windowed parts into suitably selected locations in the synthetic waveform, characterised in that said apparatus is used for diphone synthesis and includes:

first selection means for selecting a first part of said recorded waveform, said first part being a diphone, a first phoneme of which is a vowel and the other phoneme of which is a consonant required to be synthesised;

second selection means for selecting a second part of said recorded waveform, said second part being a diphone, a first phoneme of which is the consonant required to be synthesised and the other phoneme of which is a vowel;

first palindromic copying means for copying the start of a synthesised waveform for said consonant from said other phoneme of said first part of said recorded waveform using a first half of a Hanning-window function used to synthesis said vowels;

second palindromic copying means for copying the end of the synthesised waveform for said consonant from said first phoneme of said second part of said recorded waveform using the other half of said Hanning-window function;

and in that said concatenation means are adapted to link together said start and said end of said synthesised waveform, resulting from said palindromic copying, to form a synthesised waveform for said consonant.

The concatenation means may include interpolation means for effecting linear interpolation between the points on said synthesised waveform for said consonant where each half of said Hanning-window function is at a maximum, said interpolation being defined by:

a line which extends, in a linear manner, from a maximum position at the point at which said first half of the Hanning-window function is a maximum to zero at the point at which said other half of said Hanning-window function is a maximum; and a line which extends, in a linear manner, from a maximum position at the point at which said other half of the Hanning-window function is a maximum to zero at the point at which said first half of said Hanning-window function is a maximum.

The first and second palindromic copying means may be adapted to copy the synthesised waveform for said consonant between two defined lower and upper limits. The lower limit may be 30% and the upper limit may be 70%.

The foregoing and other features of the present invention will be better understood from the following description with reference to the single FIGURE of the accompanying drawings which graphically illustrates the speech synthesis method of the present invention.

It will be seen from subsequent description that the method, according to the present invention, for synthesising speech, uses 'palindromic' copying of a waveform from recorded human speech waveforms to a synthesised waveform.

In essence, the method of the present invention uses concatenation and Hanning-windows. In particular, a synthetic waveform is formed by concatenation of suitably selected parts of recorded human speech, the selected parts being out-windowed with a Hanning-window and copied into suitably selected locations in the synthetic waveform. In the case of synthesised unvoiced consonants, the method includes, as stated above, the steps of palindromically copying suitably selected parts of a waveform of said recorded human speech to form a synthesized waveform for said unvoiced consonant using concatenation. The method may be used for diphone, or polyphone, synthesis.

DETAILED DESCRIPTION OF THE PREFERRED EMBODIMENTS

The method used for diphone synthesis will now be described with reference to the single FIGURE of the accompanying drawings.

In the single FIGURE of the accompanying drawings, two diphones 'es' and 'sa', formed by the phonemes for 'e', 's' and 'a', are diagrammatically illustrated and will be used to synthesize a long phoneme 's', i.e. the phoneme 's' in the polyphone waveform 'esa' of the drawing.

The vowel 'e' has been synthesized by a Hanning-windowed glottis pulse. The first half of the same Hanning-window function is used to copy the first part of the phoneme 's', in the polyphone waveform 'esa', from the first diphone 'es'. The second half of the Hanning-window function is used to copy the end of the phoneme 's', in the polyphone waveform 'esa', from the second diphone 'sa'.

It will be seen from the drawing that, between the points $t_1$ and $t_2$ where each half of the Hanning-window function is at a maximum, interpolation lines are defined which extend, in a linear manner, from 1 at $t_1$ to 0 at $t_2$, and from 0 at $t_1$ to 1 at $t_2$. These lines indicate how much signal will be taken from the diphone 'es' in respect to that which is taken from diphone 'sa'.

Initially, the largest part will be taken from the diphone 'es' but, in the end, the largest part will be taken from the diphone 'sa'. Since the duration of the signal in the diphones is not sufficient, measures must be taken to overcome this problem.

In accordance with the invention, two limits, 30% and 70%, are, as illustrated in the drawing, defined in the diphone 'es' and these limits indicate how much influence the surrounding phonemes are likely to have on the synthesis. The copying of the first part of the phoneme 's', in the polyphone waveform 'esa', from the first diphone 'es', starts from the left and continues until the upper 70% limit is reached. At this point, the copying process is reversed, i.e. the signal is copied backwards, until the lower 30% limit has been reached, at which point the copy process is again reversed, etc.

Thus, the palindromic copying process, referred to above, for copying of the beginning of the waveform for the consonant, from the phoneme 's' of the diphone 'es', includes the steps of:

copying the phoneme 's' of the diphone 'es' starting at the beginning thereof and continuing until the 70% upper limit is reached;

on reaching the upper limit, reversing the copying process and copying the phoneme 's' of the diphone 'es' between the 70% upper limit and the 30% lower limit; and on reaching the 30% lower limit, continue with the copying process, forwards and backwards, between the upper and lower limits.

The copying of the end of the phoneme 's', in the polyphone waveform 'esa', from the second diphone 'sa', starts from the right and continues, in a manner as outlined above, for the diphone 'es', i.e. is performed between lower and upper limits 30% and 70% in an analogous manner to the palindromic copying process used for the diphone 'es', i.e. the copying process includes the steps of:

copying the phoneme 's' of the diphone 'sa' starting at the end thereof and continuing until the 70% upper limit is reached;

on reaching the upper limit, reversing the copying process and copying the phoneme 's' of the diphone 'sa' between the 70% upper limit and the 30% lower limit; and on reaching the 30% lower limit, continue with the copying process, forwards and backwards, between the upper and lower limits It will be seen from the foregoing description that, in the case of diphone synthesis, the method according to the present invention includes the steps of:

selecting a first part of the recorded waveform, i.e. the diphone 'es', the first phoneme of which is a vowel 'e' and the other phoneme of which is a consonant 's' required to be synthesised;

selecting a second part of the recorded waveform, i.e. the diphone 'sa', a first phoneme of which is the consonant 's' required to be synthesised and the other phoneme of which is a vowel 'a';

palindromically copying the start of a synthesised waveform for the consonant from the other phoneme 's' of the first part of the recorded waveform, i.e. the diphone 'es', using a first half of a Hanning-window function used to synthesis the vowels;

palindromically copying the end of the synthesised waveform for the consonant from the first phoneme 's' of the second part of the recorded waveform, i.e. the diphone 'sa', using the other half of said Hanning-window function; and concatenating said start and said end of the synthesised waveform, resulting from said palindromic copying, to form a synthesised waveform for the consonant 's'.

In essence, the concatenation process of the method of the present invention, includes the step of effecting linear interpolation between the points, $t_1$ and $t_2$, on the synthesised waveform for said consonant 's' where each half of said Hanning-window function is at a maximum. As shown in the drawing, the interpolation is, as stated above, defined by:

a line which extends, in a linear manner, from a maximum position at the point $t_1$, the point at which the first half of the Hanning-window function is a maximum, to zero at the point $t_2$, i.e. the point at which the other half of said Hanning-window function is a maximum; and a line which extends, in a linear manner, from a maximum position at the point $t_2$, i.e. the point at which the other half of the Hanning-window function is a maximum, to zero at the point $t_1$, i.e. the point at which the first half of said Hanning-window function is a maximum;

The interpolation lines indicate how much signal has been taken from each of said diphones.

The advantage of this palindromic synthesis method is that there is no repetition of identical blocks. Even if there is repetition, when the copying process has been reversed the second time, the signal from one diphone is mixed with the signal from the other diphone, and as the reversals do not normally occur at the same time for the two diphones, the mixed signals become different. The time difference between repetitions also markedly increases, in comparison with known methods, which makes it more difficult for a person listening to the synthesised speech to perceive the periodicity.

Whilst the method, outlined in the preceding paragraphs, relates to diphone synthesis, the method may be used, in a similar manner, for polyphone synthesis.

The method according to the present invention provides an increase in the quality of speech synthesis and makes it possible for such methods to be used in commercially viable speech synthesis apparatus and/or systems for either diphone synthesis and/or polyphone synthesis.

The present invention, which is a distinct improvement on known speech synthesis methods, could be used, to advantage, in such methods to improve the quality of the synthesised speech.

What is claimed is:

1. A method for synthesising speech using concatenation and Hanning-windows, in which a synthetic waveform is formed by concatenation of selected parts of diphones or polyphons of recorded human speech, said selected parts being out-windowed with a Hanning-window and copied into selected locations in the synthetic waveform, characterised in that said method is adapted to synthesise unvoiced consonants and includes the steps of palindromically copying suitably selected parts of a waveform of said recorded diphones or polyphones to form a synthesized waveform for said unvoiced consonant using concatenation.

2. A method as claimed in claim 1, characterised in that the method is used for diphone, or polyphone, synthesis.

3. A method for synthesising speech using concatenation and Hanning-windows, in which a synthetic waveform is formed by concatenation of selected parts of diphones or polyphones of recorded human speech, said selected parts being out-windowed with a Hanning-window and copied into selected locations in the synthetic waveform, characterised in that said method is used for diphone synthesis and includes the steps of:

selecting a first part of said recorded waveform, said first part being a diphone, a first phoneme of which is a vowel and the other phoneme of which is a consonant required to be synthesised;

selecting a second part of said recorded waveform, said second part being a diphone, a first phoneme of which is the consonant required to be synthesised and the other phoneme of which is a vowel;

palindromically copying the start of a synthesised waveform for said consonant from said other phoneme of said first part of said recorded waveform using a first half of a Hanning-window function used to synthesis said vowels;

palindromically copying the end of the synthesised waveform for said consonant from said first phoneme of said second part of said recorded waveform using the other half of said Hanning-window function; and concatenating said start and said end of said synthesised waveform, resulting from said palindromic copying, to form a synthesised waveform for said consonant.

4. A method as claimed in claim 3, characterised in that said concatenation includes the steps of:

effecting linear interpolation between the points on said synthesised waveform for said consonant where each half of said Hanning-window function is at a maximum;

and in that said interpolation is defined by:

a line which extends, in a linear manner, from a maximum position at the point at which said first half of the Hanning-window function is a maximum to zero at the point at which said other half of said Hanning-window function is a maximum; and a line which extends, in a linear manner, from a maximum position at the point at which said other half of the Hanning-window function is a maximum to zero at the point at which said first half of said Hanning-window function is a maximum.

5. A method as claimed in claim 4, characterised in that said interpolation lines indicate how much signal has been taken from each of said diphones.

6. A method as claimed in claim 5, for synthesizing the consonant 's', characterized in that the diphone of said first part of said recorded waveform includes phonemes for 'e' and 's' and in that the diphone of said second part of said recorded waveform includes phonemes for 's' and 'a'.

7. A method as claimed in claim 5, characterized in that the copying of the synthesized waveform for said consonant is effected between two defined lower and upper limits of each of the waveforms of said other phoneme of said first part of said recorded waveform and of said first phoneme of said second part of said recorded waveform.

8. A method as claimed in claim 4, for synthesizing the consonant 's', characterized in that the diphone of said first part of said recorded waveform includes phonemes for 'e' and 's' and in that the diphone of said second part of said recorded waveform includes phonemes for 's' and 'a'.

9. A method as claimed in claim 4, characterized in that the copying of the synthesized waveform for said consonant is effected between two defined lower and upper limits of each of the waveforms of said other phoneme of said first part of said recorded waveform and of said first phoneme of said second part of said recorded waveform.

10. A method as claimed in claim 3, for synthesising the consonant 's', characterised in that the diphone of said first part of said recorded waveform includes phonemes for 'e' and 's' and in that the diphone of said second part of said recorded waveform includes phonemes for 's' and 'a'.

11. A method as claimed in claim 10, characterised in that the vowels 'e' and 'e' are synthesized by a Hanning-windowed glottis pulse, the same Hanning-window function being used to synthesise a waveform for the consonant 's'.

12. A method as claimed in claim 3, characterised in that the copying of the synthesised waveform for said consonant is effected between two defined lower and upper limits of each of the waveforms of said other phoneme of said first part of said recorded waveform and of said first phoneme of said second part of said recorded waveform.

13. A method as claimed in claim 12, characterised in that said lower limit is 30% and said upper limit is 70%.

14. A method as claimed in claim 12, characterised in that copying of the beginning of the waveform for said consonant, from said other phoneme of said first part of said recorded waveform, includes the steps of:

copying said other phoneme starting at the beginning thereof and continuing until said upper limit is reached;

on reaching said upper limit, reversing the copying process and copying said other phoneme between said upper limit and said lower limit; and on reaching said lower limit, continue with the copying process, forwards and backwards, between said upper and lower limits.

15. A method as claimed in claim 12, characterised in that copying the end of the synthesised waveform for said consonant, from said first phoneme of said second part of said recorded waveform, includes the steps of:

copying said first phoneme starting at the end thereof and continuing until said upper limit is reached;

on reaching said upper limit, reversing the copying process and copying said first phoneme between said upper limit and said lower limit; and on reaching said lower limit, continue with the copying process, forwards and backwards, between said upper and lower limit.

16. A speech synthesis apparatus for synthesising speech using concatenation and Hanning-windows, said apparatus including concatenation means for linking together selected parts of a waveform of diphones or polyphones of recorded human speech to form a synthetic waveform for said speech, said selected parts being out-windowed with a Hanning-window, and means for copying said out-windowed parts into selected locations in the synthetic waveform, characterised in that said apparatus is adapted to synthesis unvoiced consonants and in that said selected parts of a waveform of said diphones or polyphones are palindromically copied and concatenated to form a synthesized waveform for an unvoiced consonant.

17. A speech synthesis apparatus for synthesising speech using concatenation and Hanning-windows, said apparatus including concatenation means for linking together selected parts of a waveform of diphones or polyphones of recorded human speech to form a synthetic waveform for said speech, said selected parts being out-windowed with a Hanning-window, and means for copying said out-windowed parts into selected locations in the synthetic waveform, characterised in that said apparatus is used for diphone synthesis and includes:

first selection means for selecting a first part of said recorded waveform, said first part being a diphone, a first phoneme of which is a vowel and the other phoneme of which is a consonant required to be synthesised;

second selection means for selecting a second part of said recorded waveform, said second part being a diphone, a first phoneme of which is the consonant required to be synthesised and the other phoneme of which is a vowel;

first palindromic copying means for copying the start of a synthesised waveform for said consonant from said other phoneme of said first part of said recorded waveform using a first half of a Hanning-window function used to synthesis said vowels;

second palindromic copying means for copying the end of the synthesised waveform for said consonant from said first phoneme of said second part of said recorded waveform using the other half of said Hanning-window function; and in that said concatenation means are adapted to link together said start and said end of said synthesised waveform, resulting from said palindromic copying, to form a synthesised waveform for said consonant.

18. A speech synthesis apparatus as claimed in claim 17, characterised in that said concatenation means include interpolation means for effecting linear interpolation between the points on said synthesised waveform for said consonant where each half of said Hanning-window function is at a maximum, said interpolation being defined by:

a line which extends, in a linear manner, from a maximum position at the point at which said first half of the Hanning-window function is a maximum to zero at the point at which said other half of said Hanning-window function is a maximum; and a line which extends, in a linear manner, from a maximum position at the point at which said other half of the Hanning-window function is a maximum to zero at the point at which said first half of said Hanning-window function is a maximum.

19. A speech synthesis apparatus as claimed in claim 17, characterised in that said first and second palindromic copying means are adapted to copy the synthesised waveform for said consonant between two defined lower and upper limits.

20. A speech synthesis apparatus as claimed in claim 19, characterised in that said lower limit is 30% and said upper limit is 70%.

* * * * *

UNITED STATES PATENT AND TRADEMARK OFFICE

CERTIFICATE OF CORRECTION

PATENT NO. : 6,112,178
DATED : August 29, 2000
INVENTOR(S) : Jaan Kaja

It is certified that error appears in the above-identified patent and that said Letters Patent is hereby corrected as shown below:

On the title page, item [54], and at the top of Column 1, the title should be:

--[54] VOICELESS CONSONANT SYNTHESIS BY PALINDROMIC COPYING OF SELECTED PARTS OF DIPHONES OR POLYPHONES--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*